US005899002A

United States Patent [19]

Lehtinen et al.

[11] Patent Number: 5,899,002

[45] Date of Patent: May 4, 1999

[54] METHOD AND ARRANGEMENT FOR UTILIZING ENERGY OF DRYING APPARATUS FOR FIBER WEB

[75] Inventors: Jukka Lehtinen; Jarmo Puumalainen; Paavo Rautakorpi, all of Tampere, Finland

[73] Assignee: Valmet Corporation, Helsinki, Finland

[21] Appl. No.: 08/832,730

[22] Filed: Apr. 11, 1997

[30] Foreign Application Priority Data

Apr. 12, 1996 [FI] Finland ..... 961637

[51] Int. Cl.[6] ..... F82G 13/26

[52] U.S. Cl. ..... 34/95; 34/392; 34/417; 34/624

[58] Field of Search ..... 34/65, 95, 624, 34/71, 242, 393, 392, 417, 418

[56] References Cited

U.S. PATENT DOCUMENTS

| | | | |
|---|---|---|---|
| 4,112,586 | 9/1978 | Lehtinen | 34/9 |
| 4,506,457 | 3/1985 | Lehtinen | 34/41 |
| 4,887,362 | 12/1989 | Rautakorpi | 34/41 |
| 4,958,444 | 9/1990 | Rautakorpi et al. | 34/71 |
| 5,471,765 | 12/1995 | Rautakorpi et al. | 34/242 |
| 5,566,472 | 10/1996 | Lehtinen et al. | 34/242 |
| 5,706,587 | 1/1998 | Lehtinen et al. | 34/71 |
| 5,722,182 | 3/1998 | Lehtinen et al. | 34/418 |

FOREIGN PATENT DOCUMENTS 92735 8/1994 Finland .

*Primary Examiner*—Henry A. Bennett
*Assistant Examiner*—Pamela A. Wilson
*Attorney, Agent, or Firm*—Ladas & Parry

[57] ABSTRACT

The drying apparatus comprises two endless bands (1, 2) that are impermeable to air and that have a good thermal conductivity. A fibre web (5) runs between the bands (1, 2) with at least one felt or wire (3, 4). The metal band in contact with the fibre web (5) is heated with a pressure chamber (9) containing a pressure medium that is steam. Correspondingly, the metal band in contact with the felt or wire (3, 4) is cooled. The pressure chamber (9) is sealed against the first band (1) with a seal **(9*a*). In association with the pressure chamber (9) there is a steam recovery chamber (18), where steam and condensate that escape from between the seal (9*a*) and the first band (1) can be recovered. The steam recovered from the steam recovery chamber (18)** is supplied for further use with a means according to the arrangement.

11 Claims, 2 Drawing Sheets

METHOD AND ARRANGEMENT FOR UTILIZING ENERGY OF DRYING APPARATUS FOR FIBER WEB

Figure 1:
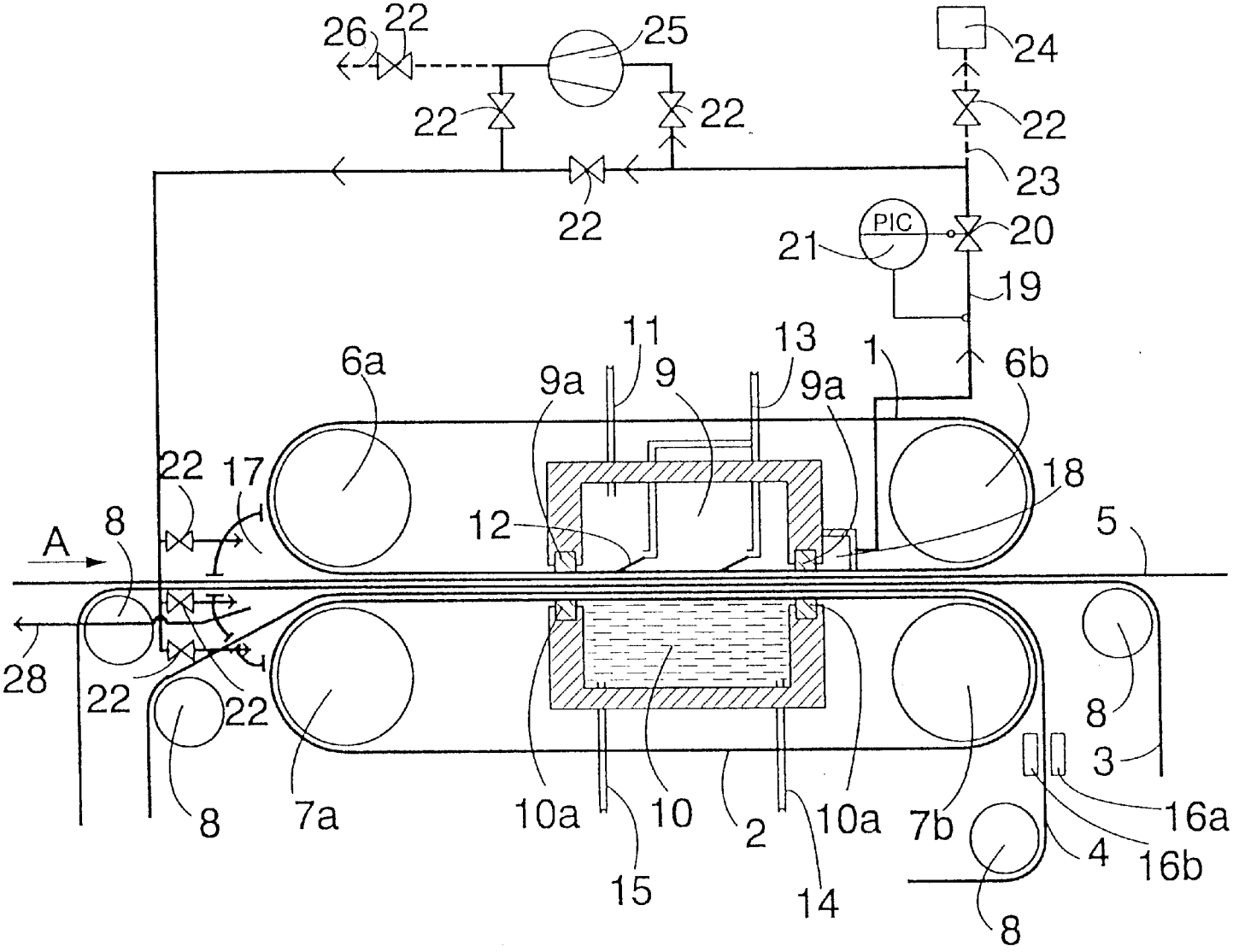

The invention relates to a method for utilizing energy of an apparatus for drying a fibre web, the apparatus comprising two endless bands impermeable to air and having a good thermal conductivity, first turning rolls, the first band being arranged to turn around the first turning rolls, and second turning rolls, the second band being arranged to turn around the second turning rolls, a pressure chamber containing a pressure medium that is steam, the pressure chamber being arranged to heat the first band and sealed against the first band with at least one seal, and a steam recovery chamber where steam and condensate that escape from between the seal and the first band can be collected, whereby the second band is cooled and the fibre web and at least one felt or wire run between the bands in such a way that the fibre web is in contact with the heated first band and the felt or wire is correspondingly situated between the fibre web and the cooled second band.

The invention also relates to an arrangement for utilizing energy of an apparatus for drying a fibre web, the apparatus comprising two endless bands impermeable to air and having a good thermal conductivity, first turning rolls, the first band being arranged to turn around the first turning rolls, and second turning rolls, the second band being arranged to turn around the second turning rolls, a pressure chamber containing a pressure medium that is steam, the pressure chamber being arranged to heat the first band and sealed against the first band with at least one seal, and a steam recovery chamber where steam and condensate that escape from between the seal and the first band can be collected, whereby the second band is cooled and the fibre web and at least one felt or wire run between the bands in such a way that the fibre web is in contact with the heated first band and the felt or wire is correspondingly situated between the fibre web and the cooled second band.

Finnish patent 92735 discloses a method and equipment where a fibre web is dried between two continuously moving metal bands in such a way that a fibre web runs between the bands together with a dryer felt, so that the metal band touching the web has been heated and the metal band touching the felt has correspondingly been cooled. In such a case, water contained in the web vaporizes under the influence of the hot metal band and passes to the felt due to the pressure of the steam, simultaneously pushing water in front of it, and the steam transferred to the felt condenses due to the effect of the cold cooled band, whereupon water passes from the web to the felt and the web is dried. The hot metal band is heated by means of a steam chamber. The steam chamber is sealed with seals against the metal band to be heated. The aforementioned reference also discloses a steam recovery chamber provided in association with the seal at the end of the steam chamber where the metal bands come into sight from between the heating and the cooling chamber. The steam discharged from the steam chamber from between the seal and the heated band can be gathered to the steam recovery chamber. Since the discharged steam cannot escape into the atmosphere, noise problems and other problems brought about by the steam can be avoided. However, the aforementioned reference does not disclose any manner of utilizing the recovered steam.

Producing live steam and supplying it for use for example in the papermaking process requires very complicated and costly investments in equipment. The preparation of live steam is also expensive due to the high cost of energy required for producing live steam. At present, steam discharged for example from an apparatus for drying a fibre web escapes for example to a hood of a papermaking machine. In such a case, only some of the energy of the discharged steam can be recovered by means of a heat recovery unit for the ventilation of a hood in a papermaking machine, but the heat recovery efficiency of this arrangement is low.

The purpose of the present invention is to provide a method and an arrangement for utilizing steam that escapes from a seal provided at the rear end of an apparatus for drying a fibre web.

The method according to the invention is characterized in that the steam recovered from the steam recovery chamber is supplied for further use.

Further, the arrangement according to the invention is characterized in that the arrangement comprises means for supplying steam recovered from the steam recovery chamber for further use.

The essential idea of the invention is that steam that escapes from a seal provided at the rear end of an apparatus for drying a fibre web and condensate that vaporizes from the surface of a hot steel band are recovered and supplied for further use. The idea of a preferred embodiment is that some of the recovered steam is supplied to an air exhaust unit of the apparatus for drying a fibre web. The idea of another preferred embodiment is that some of the recovered steam is supplied to a heat recovery unit. The idea of a third preferred embodiment is that some of the recovered steam is supplied to a steam blower where the pressure is increased and the steam is supplied for further use after the increase of pressure.

The invention has the advantage that the recovered condensate and steam can be utilized so that it is possible to save live steam required for example in the air exhaust unit or steam that is needed for some other purpose. Another advantage of the invention is that the heat contained in the steam that escapes from the seal provided at the rear end of the apparatus can be recovered.

Figure 2:
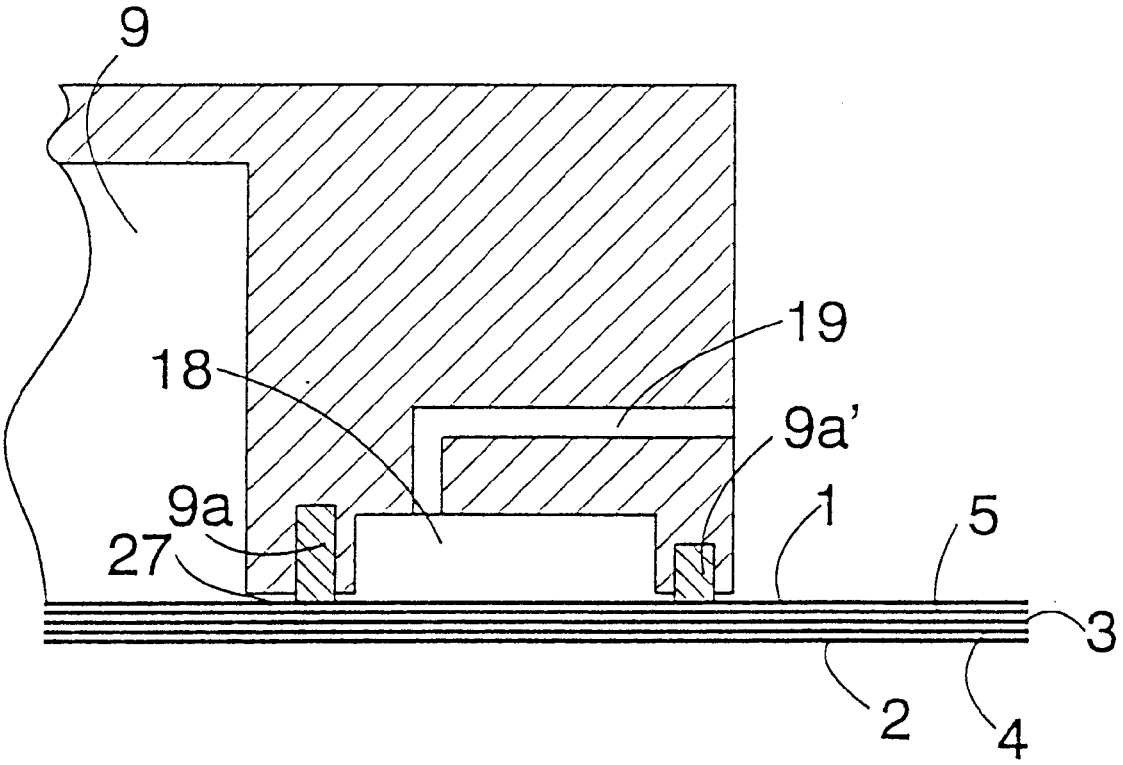

The invention will be described in greater detail in the accompanying drawings, in which FIG. 1 is a schematic side view, in cross-section, of an apparatus for drying a fibre web and of an arrangement according to the invention provided in association with the apparatus, and FIG. 2 is a schematic cross-section of an embodiment of the rear end of a pressure chamber provided in an apparatus for drying a fibre web.

FIG. 1 is a schematic side view of a drying apparatus according to the invention in a section made in the direction of travel of the web. The drying apparatus comprises an endless first band 1 or upper band and an endless second band 2 or lower band, which are impermeable to air and have a good thermal conductivity, being preferably made of metal. A fine wire or felt 3, a coarse wire 4 and a fibre web 5 move on between the band surfaces facing each other. The fibre web 5 moves in the direction shown by arrow A. The first band 1 is arranged to turn around first turning rolls 6*a* and 6*b* provided at the ends of the drying apparatus. Correspondingly, the second band 2 is arranged to turn around second turning rolls 7*a* and 7*b* also provided at the ends of the drying apparatus below the first turning rolls 6*a* and 6*b*. The wires 3 and 4 are supported and guided by guide rolls 8. Since the pressure at the drying zone in the space between the bands 1 and 2 is usually different from the pressure prevailing outside or on the sides of the bands 1 and 2, seals are provided on both sides of the apparatus between the bands 1 and 2 or near the edges thereof, to prevent liquid or gas from escaping sideways out of the space between the bands 1 and 2, or vice versa. For the steam heating required by the drying process, the drying apparatus comprises a pressure chamber 9 that is situated above the first band 1. The first band 1 is sealed with seals 9*a* to the pressure chamber 9 so that the steam in the pressure chamber 9 has a suitable pressure. Below the second band 2 there is a water chamber 10 containing water that cools the second band 2. The edges of the water chamber 10 are provided with seals 10*a* with which the second band 2 is sealed to the water chamber 10.

The operation of the drying apparatus is based on heating the first band 1 in contact with the web 5 by hot steam contained in the pressure chamber 9, whereby water contained in the web 5 vaporizes due to the high temperature of the first band 1 and passes through the wires 3 and 4 towards the second band 2. The second band 2 is in turn cooled continuously by water arranged below it, whereby steam reaching the surface of the band will condense into water and is removed with the band 2 and the wire 4.

Saturated steam is supplied to the pressure chamber 9 via a pipe 11. In the pressure chamber 9, condensation water is collected from the surface of the band 1 with condensate recovery units 12. The condensate is discharged from the condensate recovery units 12 via discharge pipes 13. Water is supplied to the water chamber 10 via an inlet pipe 14. The cooling water used is discharged via a discharge pipe 15.

The wire 4 is provided with blow boxes 16*a* and suction boxes 16*b* with which humidity is removed from the wire 4. Water can be removed from the wire 4 by using either both the blow boxes 16*a* and the suction boxes 16*b* provided on opposite sides of the wire 4, or only one of these.

Before the fibre web 5 and the wires 3 and 4 run between the bands 1 and 2, they are supplied through an air exhaust unit 17 where air is removed from the pores of the web 5 and the wires 3 and 4 as carefully as possible for example by supplying superheated or saturated steam having a suitable temperature through them, the steam pushing the air molecules out of the pores and replacing them with water molecules of the steam.

There is a steam recovery chamber 18 in association with the pressure chamber 9 at the end where the bands 1 and 2 come into sight from between the pressure chamber 9 and the water chamber 10. The steam that escapes from the pressure chamber 9 from between the seal 9*a* and the heated band 1 can be collected to the steam recovery chamber 18. In a corresponding manner, condensate that flows out from between the seal 9*a* and the heated band 1 can be collected to the steam recovery chamber 18. Majority of the condensate vaporizes in the steam recovery chamber 18 under the influence of the heated band 1.

FIG. 2 is a cross-sectional view of the rear end of a pressure chamber in an apparatus for drying a fibre web. The reference numerals of FIG. 2 correspond to those of FIG. 1. For the sake of clarity, FIG. 2 does not show the part situated below the second band 2. The sealing surface of the seal 9*a* is in contact with the surface of the band 1 and it keeps the band surface at a distance from the surface of the edge of the pressure chamber 9 so that a steam opening 27 remains between the lower surface of the edge of the pressure chamber 9 and the upper surface of the band 1. The edge of the pressure chamber 9 is provided with seals 9*a* and 9*a*', and a steam recovery chamber 18 is provided between them. Steam and condensate flow between the seal 9*a* and the upper band 1 along the steam opening 27 to the steam recovery chamber 18 from where they are discharged via a pipe 19. With a seal 9*a*' that touches the band 1 lightly it is possible to prevent steam from escaping. The steam recovery chamber 18 should be provided with a considerably lower pressure than the actual pressure chamber 9 to ensure the immediate evaporation of the discharged condensate from the surface of the band 1. Any seals that are suitable for sealing a sliding surface can be employed. The seal can be a separate seal or, if desired, it can be provided at the edge of the chamber by shaping it as a sealing surface. The number of successive seals and chambers can be varied to achieve suitable tightness and operating life for the seals.

The chamber 18 is suitably designed in such a way that condensate situated on the surface of the steel band 1 has time to vaporize from the surface of the hot steel band in the area of the chamber 18.

From the steam recovery chamber 18 the steam is supplied along the pipe 19 for reuse in the manner shown in FIG. 1. The flow of steam in the pipe 19 is adjusted with a regulator 21 controlling a valve 20. With the pipe 19 at least some of the steam can be supplied to an air exhaust unit 17. The flow of steam in the piping 19 is guided and adjusted by means of valves 22. As shown in FIG. 1, steam can be supplied to different zones of the air exhaust chamber suitably by means of the valves 22 in order to minimise the air content between the steel bands. Further, suction is provided in the air exhaust chamber by means of a pipe 28. The suction is intended to remove the part of the steam that is not condensed in the wires 3 and 4, in the fibre web 5 and in the structures of the air exhaust chamber, or that does not flow out via the seams between the movable surfaces of the air exhaust chamber.

From the piping 19 some of the recovered steam can be supplied along a pipe branch 23 to a heat recovery unit 24. In the heat recovery unit 24 some of the thermal energy contained in the steam can be recovered.

With the piping 19 some of the steam can also be supplied to a steam blower 25 or a compressor. The transfer of steam can be further guided by means of the valves 22. With the steam blower 25 it is possible to increase the pressure of the steam. The pressure of the steam obtained from the steam recovery chamber 18 is typically in the range of an overpressure of 20 to 30 kPa, whereas a compressor provides steam with an even higher pressure. With the steam blower 25 the pressure of the steam can be increased for example to an overpressure of 60 to 70 kPa. Such steam can be supplied further to some other use for example by means of piping 26.

The drawings and the related description are only intended to illustrate the inventive idea. The details of the invention may vary within the scope of the claims. Therefore, it is not essential which medium is used in the water chamber 10. Besides water, the medium of the water chamber 10 may also be for example air or some other suitable medium. The heated first band 1 can also be heated before it arrives at the drying zone for example in a separate heating zone or by using the first turning rolls 6*a* and 6*b* as heating means. The cooled second band 2 can be correspondingly cooled before the drying zone for example by means of air cooling or quench condensation or by supplying a suitable cooling medium, such as water, to the rolls of the second band 2, for example to the second turning rolls 7*a* and 7*b*.

We claim:

1. A method for utilizing energy of an apparatus for drying a fibre web, the apparatus comprising two endless bands impermeable to air and having a good thermal conductivity, first turning rolls, the first band being arranged to turn around the first turning rolls, second turning rolls, the second band being arranged to turn around the second turning rolls, a pressure chamber containing a pressure medium that is steam, the pressure chamber being arranged to heat the first band and sealed against the first band with at least one seal, and a steam recovery chamber where steam and condensate that escape from between the seal and the first band can be collected, whereby the second band is cooled and the fibre web and at least one felt or wire run between the bands in such a way that the fibre web is in contact with the heated first band and the felt or wire is correspondingly situated between the fibre web and the cooled second band, wherein the steam recovered from the steam recovery chamber is supplied for further use.

2. A method according to claim 1, wherein the drying apparatus further comprises an air exhaust unit for removing air from the fibre web, and at least some of the steam recovered from the steam recovery chamber is supplied to the air exhaust unit.

3. A method according to claim 1, wherein at least some of the steam recovered from the steam recovery chamber is supplied to a heat recovery unit.

4. A method according to claim 1, wherein at least some of the steam recovered from the steam recovery chamber is supplied to a steam blower where the pressure of the steam is increased and the steam is supplied for further use.

5. A method according to claim 1, wherein the drying apparatus further comprises an air exhaust unit for removing air from the felt or wire, and at least some of the steam recovered from the steam recovery chamber is supplied to the air exhaust unit.

6. A method according to claim 1, wherein at least some of the steam recovered from the steam recovery chamber is supplied to a compressor where the pressure of the steam is increased and the steam is supplied for further use.

7. An arrangement for utilizing energy of an apparatus for drying a fibre web, the apparatus comprising two endless bands impermeable to air and having a good thermal conductivity, first turning rolls, the first band being arranged to turn around the first turning rolls, second turning rolls, the second band being arranged to turn around the second turning rolls, a pressure chamber containing a pressure medium that is steam, the pressure chamber being arranged to heat the first band and sealed against the first band with at least one seal, and a steam recovery chamber where steam and condensate that escape from between the seal and the first band can be collected, whereby the second band is cooled and the fibre web and at least one felt or wire run between the bands in such a way that the fibre web is in contact with the heated first band and the felt or wire is correspondingly situated between the fibre web and the cooled second band, the arrangement comprising means for supplying steam recovered from the steam recovery chamber for further use.

8. An arrangement according to claim 7, the drying apparatus further comprising an air exhaust unit for removing air from the fibre web and the felt or wire, and the arrangement comprising means for supplying at least some of the steam recovered from the steam recovery chamber to the air exhaust unit.

9. An arrangement according to claim 7, the arrangement further comprising means for supplying at least some of the steam recovered from the steam recovery chamber to the heat recovery unit.

10. An arrangement according to claim 7, the arrangement further comprising a steam blower with which the pressure of the steam can be increased, and means for supplying at least some of the steam recovered from the steam recovery chamber to the steam blower and for further use.

11. An arrangement according to claim 5, the arrangement further comprising a compressor with which the pressure of the steam can be increased, and means for supplying at least some of the steam recovered from the steam recovery chamber to the compressor and for further use.

* * * * *